US007997543B1

(12) United States Patent
Campbell

(10) Patent No.: US 7,997,543 B1
(45) Date of Patent: Aug. 16, 2011

(54) VERSATILE SUPPORT APPARATUS AND METHODS THEREOF

(76) Inventor: Sharon Campbell, North Las Vegas, NV (US)

( * ) Notice: Subject to any disclaimer, the term of this patent is extended or adjusted under 35 U.S.C. 154(b) by 658 days.

(21) Appl. No.: 11/930,110

(22) Filed: Oct. 31, 2007

Related U.S. Application Data

(63) Continuation-in-part of application No. 11/786,811, filed on Apr. 13, 2007, now abandoned.

(51) Int. Cl.
*A63B 55/04* (2006.01)

(52) U.S. Cl. ..... 248/97; 248/95; 248/99; 248/100; 248/101; 383/33; 220/495.11

(58) Field of Classification Search ..... 248/95, 248/97, 99, 100, 101; 383/33; 220/495.11
See application file for complete search history.

(56) References Cited

U.S. PATENT DOCUMENTS

| | | | | | |
|---|---|---|---|---|---|
| 1,186,714 | A | * | 6/1916 | Vonderahe | 248/99 |
| 3,278,116 | A | * | 10/1966 | Petty | 52/750 |
| 3,420,483 | A | * | 1/1969 | Stalker | 248/95 |
| 3,502,291 | A | | 3/1970 | Ackerman et al. | |
| 3,614,041 | A | | 10/1971 | Koger | |
| 3,614,042 | A | | 10/1971 | Jensen | |
| 3,747,307 | A | * | 7/1973 | Peshina et al. | 55/379 |
| 4,281,813 | A | * | 8/1981 | Garrity | 248/97 |
| 4,284,205 | A | * | 8/1981 | Hirata | 229/154 |
| 4,293,111 | A | * | 10/1981 | Henri | 248/95 |
| 4,299,365 | A | * | 11/1981 | Battle | 248/99 |
| 4,940,200 | A | * | 7/1990 | Sawyer et al. | 248/97 |
| 5,119,960 | A | * | 6/1992 | Robbins, III | 220/640 |
| 5,129,609 | A | * | 7/1992 | Tobin | 248/97 |
| 5,271,589 | A | * | 12/1993 | Belous | 248/97 |
| 5,405,006 | A | * | 4/1995 | Burgdorf et al. | 206/386 |
| 5,772,046 | A | | 6/1998 | Tercher et al. | |
| 5,918,651 | A | | 7/1999 | Gazdy et al. | |
| 6,007,030 | A | * | 12/1999 | Judge | 248/95 |
| 6,179,150 | B1 | * | 1/2001 | Fogler | 220/489 |
| 6,494,619 | B1 | * | 12/2002 | Sulpizio | 383/33 |
| 6,659,407 | B2 | * | 12/2003 | Asaro | 248/97 |
| 7,029,205 | B2 | * | 4/2006 | Daigle | 405/157 |
| 7,398,913 | B2 | * | 7/2008 | McClure | 229/117.35 |
| 7,694,838 | B2 | * | 4/2010 | Yang et al. | 220/495.11 |
| 2002/0130224 | A1 | * | 9/2002 | Asaro | 248/95 |
| 2005/0199632 | A1 | * | 9/2005 | Anderson | 220/495.01 |
| 2006/0056741 | A1 | * | 3/2006 | Yang et al. | 383/33 |
| 2007/0187558 | A1 | | 8/2007 | Blodgett et al. | |

* cited by examiner

*Primary Examiner* — Nkeisha Smith
(74) *Attorney, Agent, or Firm* — Connie R. Masters

(57) ABSTRACT

The versatile support apparatus has an assembly including a plurality of substantially rigid longitudinal members. At least one substantially flexible member may be coupled transversally to a portion of each of the plurality of longitudinal members. Each longitudinal member of the plurality of longitudinal members may be repositioned about a longitudinal axis of the longitudinal member. A portion of a first end of a first longitudinal side of the assembly may be selectively coupled to a portion of an opposite second end of an opposite second longitudinal side of the assembly. When the portion of the first end is coupled to the portion of the opposite second end, the support apparatus is configured to support an object within an inner portion of the assembly.

1 Claim, 7 Drawing Sheets

VERSATILE SUPPORT APPARATUS AND METHODS THEREOF

CROSS-REFERENCE TO RELATED APPLICATION

This application is a Continuation-in-Part of U.S. application Ser. No. 11/786,811, filed Apr. 13, 2007 in the name of the same Applicant.

FIELD OF THE INVENTION

This invention generally relates to apparatus, which reinforce objects and more specifically to versatile support apparatus used as bag holders for plastic bags that may need to be filled or from which access may be needed to objects contained therein and which have a wide range of uses other than as bag holders, as well as providing adornment as desired.

BACKGROUND OF THE INVENTION

In the past, a number of bag holders have been disclosed that specifically provide some framework elements that hold plastic bags open while filling or accessing the plastic bags. Thus, by way of example, a number of the disclosures, including U.S. Pat. Nos. 3,502,291, 3,614,041 and 3,614,042, show plastic bags in holders in an upright and open position.

In the prior art disclosures, reference is often made to non-rigid storage plastic bags that may be resealed and which are currently sold under various trade names and trademarks. Most plastic storage bags may comprise materials such as polyethylene or polypropylene and have been in use for many years. Commonly, resealable storage bags may hold various contents, including solids and liquids, and effectively retain the contents without spilling them, while permitting a user to access the contents without having to tear open the bags or resort to separate ties.

Multiple disclosures show holders that may be suitable for conveniently holding other types of bags open to receive other materials, such as for garbage or for leaves and the like. According to most prior art disclosures, a user may keep a bag in an open position so that items may be put into the bag without having to hold the bag open and upright. However, as expected, there are some deficiencies in the prior art.

In most of the prior art, the holders do not completely surround a bag supported by the holder. Often bag holders that have been disclosed comprise unsightly frame elements that might allow a portion of the bag to be seen. Furthermore, even though a traditional trash can holder may support a plastic bag, often the trash holder can not be easily folded flat for storage.

By and large most of the prior art disclosures do not address the issue of holding up a standard gallon size or quart size resealable bag so that the lip of the bag can be folded over the lip of the framework elements. Thus, in these disclosures, a bag may be held open while the bottom of the bag does not rest on a support surface, which may result in bags being distorted or torn prematurely. However, Tercher et al., U.S. Pat. No. 5,772,046 specifically address this issue, but not the issue of surrounding a bag fully. In another disclosure, Gazdy et al., U.S. Pat. No. 5,918,651 address both the issue of a bottom support and surround a bag, but do not provide for a framework that may be collapsible. Besides, Gazdy et al. may lead to greater bag distortion and premature tearing because of use of a top portion, which wedges a bag between a wall and the top portion. In yet another more recent disclosure to Blodgett et al., U.S. Patent Application 2007/0187558 a food storage bag holder comprises a cylinder or frame with the top rim adapted to frictionally engage a folded over top of a storage bag. However, the Blodgett disclosure also exhibits the same deficiencies in the prior art as discussed above. While some of the prior art discloses holders with frames that fold flat, these holders typically do not automatically spring open for use.

Each of the prior art disclosures cites the convenience of use of the holders and provides one or more frameworks that may hold the bags. Often, the complexity and economics of constructing these holders may deter practical use of the disclosed holders. Additionally, the disclosed holders may be cumbersome to store and often may have limited specific use. In other words, they may be single use items. However, consumers may often prefer to have multiple uses for their purchased goods.

SUMMARY OF THE INVENTION

The currently disclosed versatile support apparatus have multiple ornamental and functional uses and may be configured easily to provide much sought after ornamental appearances while being highly functional and adaptable to various needs so that they are not single use items.

The versatile support apparatus disclosed herein are generally economical and easy to manufacture. Further consumers may find these versatile support apparatus highly useful and may provide multiple options for their use. The various embodiments disclosed herein are meant to be illustrative of the general concept and are not intended to limit any facet of this disclosure.

In accordance with an embodiment of this invention, a versatile support apparatus is disclosed. In an exemplary embodiment a versatile support apparatus, comprises in combination, an assembly including a plurality of substantially rigid longitudinal members and at least one substantially flexible member coupled transversally to a portion of each of the plurality of longitudinal members. Each longitudinal member of the plurality of longitudinal members may be repositionable about a longitudinal axis of the longitudinal member. A portion of an end of a longitudinal side of the assembly may be selectively coupled to a portion of an opposite end of an opposite longitudinal side of the assembly. When the portion of the end is coupled to the portion of the opposite end, the support apparatus may be configured to support an object within an inner portion of the assembly.

In an aspect, the object comprises at least one of the following: a substantially non-rigid bag, a re-sealable bag, a container, a vase.

In another aspect, the support apparatus may further comprise an inner portion of the longitudinal side and an inner portion of the opposite longitudinal side of the assembly. The portion of the end of the longitudinal side may selectively couple to the inner portion of the longitudinal side and the portion of the end of the opposite longitudinal side may selectively couple to the inner portion of the opposite longitudinal side to provide two support apparatus.

In yet another aspect, each of the portion of the end of the longitudinal side and the portion of the opposite end of the opposite longitudinal side may comprise coupling means selected from the group consisting of one or more complementary elements of a hook and loop assembly, one or more pressure sensitive adhesive systems, one or more button systems and one or more zipper systems.

In another aspect, the support apparatus further comprises a segment proximate to a transverse edge of the longitudinal side of the assembly and a segment proximate to a transverse edge of the opposite longitudinal side of the assembly. When the segment of the transverse edge is selectively coupled to a segment of a transverse edge of a longitudinal side of another assembly, the combined length of the assembly and the other assembly extends in a longitudinal direction.

In yet another aspect the assembly of longitudinal members may comprise at least one insulating material. Further, the assembly may comprise a trivet configured to receive at least one of the following: a casserole dish and a pan.

In another aspect, the at least one substantially flexible member comprises a fabric configured to fold over at least one of the following: a portion of a transverse edge and a portion of an opposite transverse edge of the assembly. Furthermore, the at least one substantially flexible member may comprise at least one of the following: one or more threads and one or more sheets coupled to at least a portion of each of the plurality of longitudinal members of the assembly.

In accordance with another embodiment of this invention a support apparatus is disclosed. The support apparatus, comprises in combination, a first assembly including a first plurality of substantially rigid longitudinal members and a second assembly including a second plurality of substantially rigid longitudinal members. Each of the first assembly and the second assembly may be substantially transversally flexibly biased relative to each of the first and second plurality of longitudinal members. An end of the first assembly may be hingedly coupled to an end of the second assembly and an opposite end of the first assembly may be hingedly coupled to an opposite end of the second assembly to define an inner enclosure of the first and second assembly. Moreover, the inner enclosure may be configured to receive an object. A portion of the inner enclosure may include at least one torsion spring. An end of the torsion spring may be coupled to a first member and an opposite end of the torsion spring may be coupled to a second member, wherein the torsion spring flexibly biases the first and the second member to open the inner enclosure. Further, a retainer has a channel configured to receive an outer portion of the first assembly and an outer portion of the second assembly within the channel to selectively close the support apparatus.

In another aspect the apparatus may further comprise at least one hinge member. The hinge member may include a first wall and a second wall defining an opening configured to receive a portion of the end of the first assembly, and the at least one hinge member further may comprise a third wall and a fourth wall defining a second opening configured to receive a portion of an end of the second assembly.

In an aspect, the object comprises at least one of the following: a substantially non-rigid bag, a re-sealable bag, a container, a vase.

In a further aspect, the apparatus may be sized to receive a re-sealable bag, wherein a portion of the re-sealable bag may be selectively folded over a portion of an upper edge of the apparatus and a bottom portion of the re-sealable bag may contact a surface receiving a lower edge of the apparatus to further support the re-sealable bag. Furthermore, the apparatus may be sized to receive any of the following sized re-sealable bags: a gallon bag, a quart bag and a sandwich bag.

In accordance with another embodiment of this invention, a method of manufacturing a versatile support apparatus is disclosed. The method may comprise a number of steps. Initially, a plurality of substantially rigid longitudinal members may be provided. Each of the plurality of substantially rigid longitudinal members may be aligned. At least a portion of each of the plurality of longitudinal members may be coupled to at least a portion of at least one transverse flexible member to provide an assembly thereof. Further a first selective coupling means may be coupled to a portion of an end of a longitudinal side of the assembly and a second selective coupling means may be coupled to a portion of an opposite end of an opposite longitudinal side of the assembly.

In another aspect, a third selective coupling means may be coupled proximate to a transverse edge of the longitudinal side of the assembly. Further, a fourth selective coupling means may be coupled proximate to an opposite transverse edge of an opposite longitudinal side of the assembly.

The foregoing and other objects, features, and advantages of the invention will be apparent from the following, more detailed description of the various embodiments of the invention, as illustrated in the accompanying drawings and photographs.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DESCRIPTION OF THE INVENTION

Figure 1:
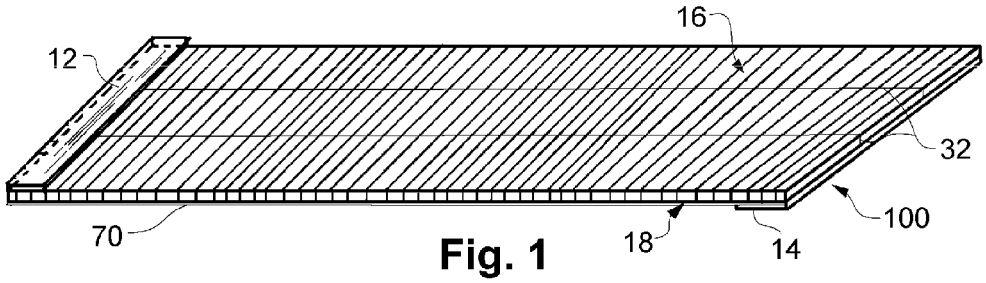
FIG. 1 depicts a side perspective view of a support apparatus in an open position in accordance with an exemplary embodiment of this invention.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature may be called out in another drawing.

The Figures are numbered and annotated so that one skilled in the art of support apparatus and construction methods thereof, by reference to the Figures, will easily be able to understand the materials and method of construction and will be able to easily assemble the parts to achieve the functionality shown.

In the Summary and Preferred Embodiments above, the Description of the Invention, and the Claims and Abstract below, and in the accompanying drawings, reference may be made to particular features (including method steps) of the invention. It is to be understood that this disclosure includes most possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

The term "comprises" and grammatical equivalents thereof are used herein to mean that other components, ingredients, steps etc. are optionally present. For example, an article "comprising" (or "which comprises") components A, B and C can consist of (i.e. contain only) components A, B and C, or can contain not only components A, B and C but also one or more other components.

Where reference is made herein to a method comprising two or more defined steps, the defined steps may be implemented in any order or simultaneously (except where the context excludes that possibility). Moreover, the method may include one or more other steps that may be implemented before any of the defined steps, between two of the defined steps, or after all the defined steps (except where the context excludes that possibility).

The term "at least" as denoted herein means one or more, while the term a "plurality" means two or more.

The term "or" is used herein as a conjunction used to link alternatives in a series of alternatives. The term "and/or" is used herein as a conjunction meaning that either or both of two options may be valid.

The term "and" is used herein as a conjunction to indicate an additional thing, situation or fact.

When used in the appended claims the term "comprising at least one of A and B" as used herein (depending on the context of the specification) may mean: comprising either one of A or of B (and more), or comprising both of A and of B (and more). As is understood in the patent art, "comprising A" means "A and more", while "comprising B" means "B and more". Thus if A is excluded according to the context of the specification in the phrase "comprising at least one of A and B", then A cannot be part of the "and more" and similarly for B if B is excluded according to the context of the specification.

When an element includes a list of numbers following the named element separated by commas, the meaning of this list refers to the named elements in the conjunctive form "and/or", unless otherwise noted. For example, the term: "a member 10, 12, 14, 16, 18" would mean "a member 10 and/or a member 12 and/or a member 14 and/or a member 16 and/or a member 18".

FIG. 1 depicts a side perspective view of an exemplary embodiment of a support apparatus 100. The support apparatus 100 may comprise an assembly of more than one substantially longitudinal members 10 and a portion of a side of each longitudinal member may be coupled to a portion of an opposite side of an adjacent substantially longitudinal member (see FIG. 7B and the description below). Alternatively, a portion of an edge of each longitudinal member 10 may be coupled to a portion of an edge of an adjacent longitudinal member (see FIG. 7A and the description below). Further, of course, each side of the longitudinal member 10 may be separated by any predetermined distance from an opposite side of an adjacent longitudinal member, so that the side of a first longitudinal member and an opposite side of an adjacent second longitudinal member may define an opening 72 or 82 (see FIGS. 7A and 7B, and the description below). Without limiting the disclosure, a portion of a side of each longitudinal member 10 may be coupled to a portion of a side of an adjacent longitudinal member with a substantially flexible material 70 (see FIG. 7A and the description below).

Furthermore, without limiting the disclosure, the width of the assembly of the longitudinal members 10 of the support apparatus 100 may substantially exceed the length of each of the longitudinal members so that the support apparatus may have a substantially rectangular shape. In an aspect of the disclosure, each longitudinal member 10 may be substantially flexibly repositionable about a central longitudinal axis of each longitudinal member while maintaining longitudinal rigidity to the support apparatus 100. In other words, the support apparatus 100 may substantially comprise a mat (or backing) 70 with each longitudinal member 10 configured to move independently of any other longitudinal member.

Each longitudinal member 10 may comprise any substantially rigid material including but not limited to one or more natural fibrous materials such as bamboo, wood and the like or one or more synthetic polymers such as polyvinyl chloride, polyethylene, polypropylene, polystyrene, polyamide, polyester, combinations thereof whether filled or unfilled and the like as is known in the art or that may be introduced into the art in the future. Of course, each longitudinal member 10 may further comprise a reinforced polymer such as fiberglass and polyester or bamboo and polyester or combinations of natural fibers and of natural or synthetic polymeric resins and the like as is known in the art or that may be introduced into the art in the future.

According to FIG. 1, a first portion (or joint) 12 of an end located on a side 16 of the support apparatus 100 may comprise one or more elements of a hook and loop assembly. Similarly, a second portion (or joint) 14 of an opposite end of the support apparatus 100 may comprise one or more complementary elements of the hook and loop assembly. Without limiting the disclosure, of course, the hook and loop assembly is but one of a number of coupling means. Some examples of coupling means may be selected from one or more of the following: pressure sensitive adhesive systems, buttons, zippers, permanent adhesive systems (whether in tape or semi-solid or liquid form), or any other suitable coupling means as is understood in the art or that may be introduced into the art in the future. In an aspect of the disclosure, if the coupling means were impermanent, this would permit opening and closing, as well as flexibility in alignment or re-alignment of the support apparatus 100 as may be desired (see FIGS. 2 and 2A-2E, and the description below).

Without limiting the disclosure, the support apparatus 100 may be colorized and sculptured as desired to provide any ornamental appearance. Moreover, any longitudinal member 10 need not comprise the same dimensions as any other longitudinal member so that the support apparatus 100 may appear ornamentally irregular without altering the functionality of the support apparatus. Naturally, each longitudinal member 10 may have any desired cross-sectional shape, including, but not limited to substantially circular, square, rectangular, elliptical and the like as desired. Furthermore, as expected any longitudinal member's 10 cross-sectional shape may comprise one or more walls defining an opening (or hollow) such as a well understood straw shape or bamboo shape.

Figure 1A:
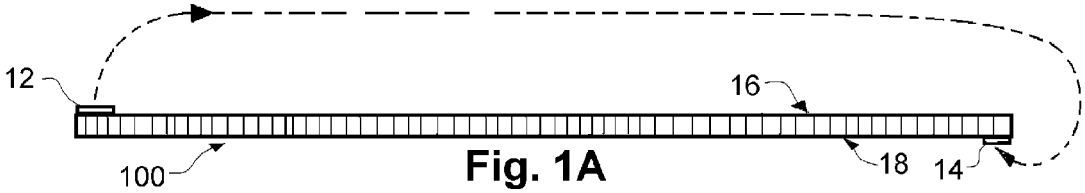
FIG. 1A depicts a side elevation view illustrating a method of coupling a first end of the support apparatus of FIG. 1 to an opposite end of the support apparatus.

FIG. 1A depicts a side elevation view of the support apparatus 100 (see also the description of FIG. 1 above) illustrating a method of coupling the first portion (or joint) 12 of an end of the support apparatus to the second portion (or joint) 14 of an opposite end of the support apparatus. As discussed above, the first portion 12 of the end and the second portion 14 of the opposite end may include a variety of coupling means. Thus, with reference to FIG. 1A, the first portion 12 may be located on the first side 16, while the second portion 14 may be located on a second side 18 of the support apparatus 100. Consequently, referring now to FIG. 2A, when the first portion 12 is coupled to the second portion 14, in a top plan view of the closed support apparatus 100, the top (and/or bottom) portion of the closed support apparatus may be configured to any suitable shape (shown substantially as a rectangle or a square) including of course, round, elliptic and the like as desired.

Figure 2:
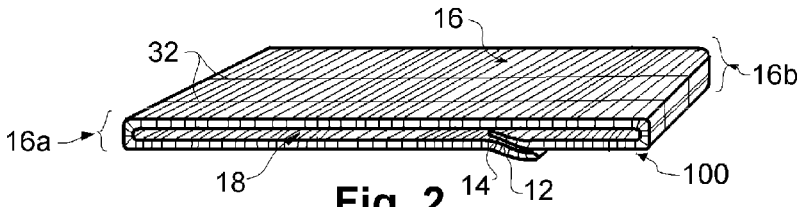
FIG. 2 depicts a side perspective view showing the folded support apparatus of FIG. 1 and with an end coupled to an opposite end of the support apparatus.

FIG. 2 depicts a side perspective view showing the folded support apparatus 100 when the first portion 12 of an end is coupled to a second portion 14 of the opposite end of the support apparatus. Such folding of the support apparatus 100 illustrates that each of the longitudinal members 10 may be substantially rigid. However, inspection of a corner portion 16*a* and an opposite corner portion 16*b* of the side 16 and the opposite side 18 readily shows that the portion of the support apparatus 100 defined by transverse coupling (see FIG. 7A and FIG. 7B and the description below) of each longitudinal member 10 to an adjacent longitudinal member may permit substantial repositioning about a longitudinal axis of each longitudinal member of the support apparatus 100. Thus, more than one longitudinal members 10 of the corner portions 16*a*, 16*b* may be collectively turned through about 360 degrees in a direction transverse to the axis of each longitudinal member to provide the folded support apparatus 100.

Figure 1B:
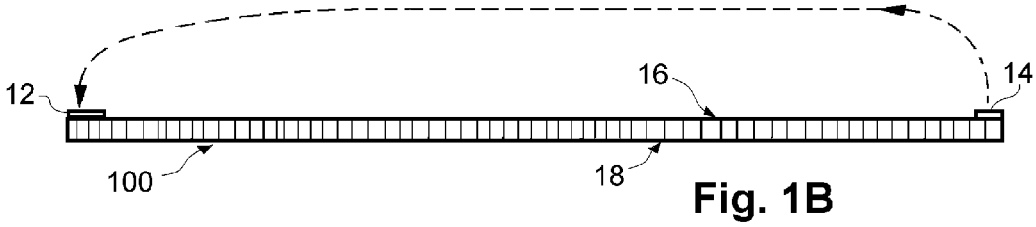
FIG. 1B depicts a side elevation view illustrating an alternative method of coupling a first end of another embodiment of a support apparatus to an opposite end of the support apparatus.

Similarly, FIG. 1B depicts a side elevation view of the support apparatus 100 (see also the description of FIG. 1 above) illustrating a method of coupling the first portion 12 of an end of the support apparatus to the second portion 14 of an opposite end of the support apparatus. However, the first portion 12 and the second portion 14 may be located on the same side 16 (or 18). Consequently, referring now to FIG. 2B, in a top plan view of the closed support apparatus 100, when the first portion 12 is coupled to the second portion 14, the shape of the top and/or bottom portions of the closed support apparatus may be configured substantially in a square or rectangular shape with the ends projecting outwardly. Naturally, because of the repositioning flexibility of each of the rigid longitudinal members 10 about each other, virtually any desired shape of the top and bottom portions of the closed support apparatus 100 may be provided. It will be appreciated that the shape of the top and the bottom portions of the closed support apparatus 100 may differ because each longitudinal member 10 may be skewed relative to another longitudinal member.

Figure 1C:
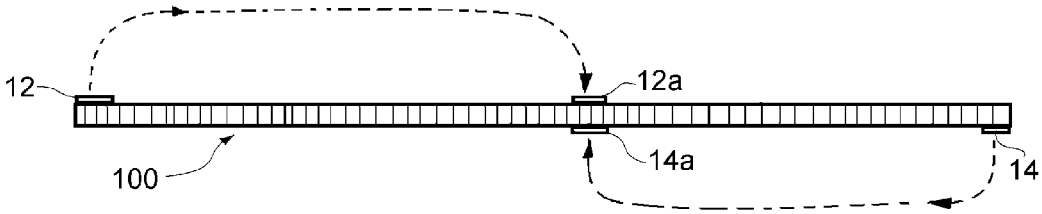
FIG. 1C depicts a side elevation view illustrating an alternative method of coupling a first end of yet another embodiment of a support apparatus to an inner portion of the support apparatus and an opposite end of the support apparatus to yet another inner portion of the support apparatus.
Figure 2C:
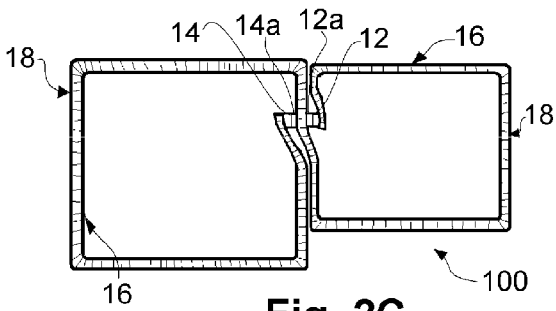
FIG. 2C depicts a top plan view of the yet another alternative embodiment of the support apparatus of FIG. 1C configured substantially in more than one square or one rectangular shape.
Figure 2A:
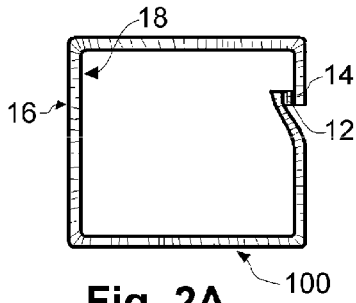
FIG. 2A depicts a top plan view of the support apparatus of FIG. 1A configured substantially in a square or rectangular shape.
Figure 2B:
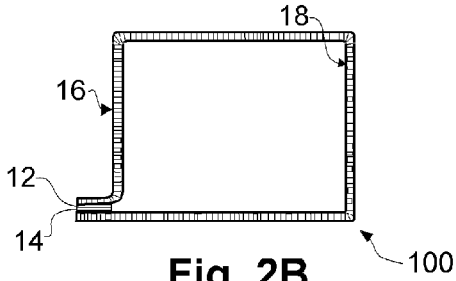
FIG. 2B depicts a top plan view of the alternative embodiment of the support apparatus of FIG. 1B configured substantially in a square or rectangular shape with the ends projecting outwardly.

Referring now to FIG. 1C, a side elevation view of another embodiment of the support apparatus 100 comprises a first portion 12 of an end of the support apparatus and an inner portion 12*a* of the support apparatus located on the same side 16 and a second portion 14 of an opposite end of the support apparatus and another inner portion 14*a* on the opposite side 18 of the support apparatus. As illustrated, the first portion 12 may be coupled to the inner portion 12*a* and the second portion 14 may be coupled to the other inner portion 14*a*. Naturally, an alternative coupling of the first portion 12 to the inner portion 14*a*, as well as a coupling of the second portion 14 to the inner portion 12*a* may also occur. FIG. 2C illustrates a top plan view (which could be substantially the same as the bottom plan view) that may result from coupling the first portion 12 to the inner portion 12*a* and the second portion 14 to the inner portion 14*a* to provide a pair of square or rectangular prismatic support apparatus 100. It will be readily appreciated that the support apparatus 100 may be configured in a variety of manners to provide versatile shapes as desired.

Figure 2D:
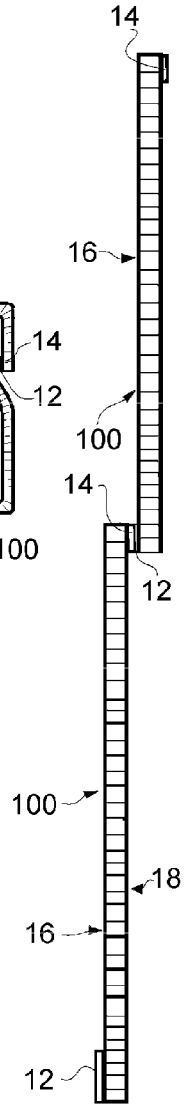
FIG. 2D depicts a side elevation view showing an end of the support apparatus of FIG. 1 coupled to an opposite end of another of the support apparatus of FIG. 1.

FIG. 2D depicts a side elevation view showing a first portion 12 of an end of the support apparatus 100 coupled to a second portion 14 of an opposite end of another of the support apparatus. Thus, the support apparatus 100 may be extended in a substantially transverse direction to the longitudinal members 10 to increase the size of the support apparatus. Of course, as many support apparatus 100 as may be desired may be coupled to provide an end-to-end extended support apparatus.

Figure 2E:
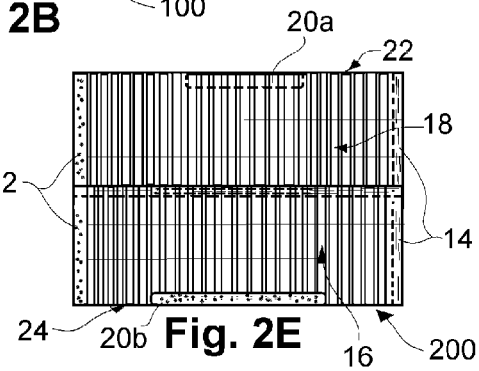
FIG. 2E depicts a plan view of a portion of an edge of a support apparatus coupled to a portion of an opposite edge of a support apparatus according to another embodiment of the invention.

FIG. 2E depicts a plan view showing a portion of an edge 22 of another embodiment of the support apparatus 200 coupled to a portion of an opposite edge 24 of another of the support apparatus 200. Significantly, each support apparatus 200 may be extended with yet another support apparatus by coupling the support apparatus along the edges 22, 24 as desired to readily increase the overall size of the support apparatus in the longitudinal direction of the longitudinal members 10. Accordingly, the support apparatus 200 may comprise a first segment 20*a* proximate to the edge 22 and a second segment 20*b* proximate to the opposite edge 24. It will be appreciated that the first segment 20*a* may be located on the side 16 while the second segment 20*b* may be located on the side 18. However, the first and second segments 20*a*, 20*b* may be co-located on either of sides 16 or 18. Furthermore, in the same manner as described with respect to the support apparatus 100 (see FIG. 1 and the description above), the support apparatus 200 may comprise a first portion 12 at an end and a second portion 14 at an opposite end. The first segment 20*a* and the second segment 20*b* may comprise one or more elements of a hook and loop assembly and one or more complementary elements of the hook and loop assembly. Naturally, without limiting the disclosure, of course, the hook and loop assembly is but one of a number of coupling means. Some examples of coupling means may comprise one or more of the following: pressure sensitive adhesive systems, buttons, zippers, or any other suitable coupling means as is understood in the art or that may be introduced into the art in the future that permits variable coupling between the segments 20*a*, 20*b*. Of course, as many support apparatus 200 as may be desired may be coupled to provide an edge-to-edge extended support apparatus. Naturally, any edge-to-edge support apparatus may also be extended as an end-to-end support apparatus as described above with respect to FIG. 2D.

Figure 3:
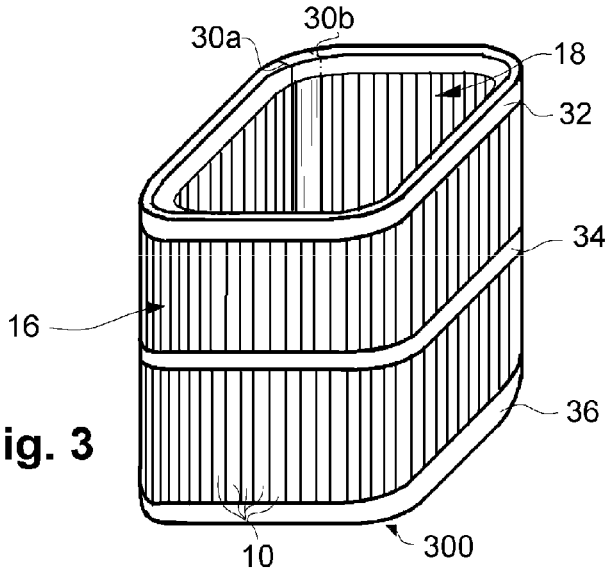
FIG. 3 depicts a front perspective view of the support apparatus of FIG. 1 when a first end of the support apparatus is coupled to an opposite end of the support apparatus according to an embodiment of this invention.

FIG. 3 depicts another embodiment of the support apparatus 300, which is similar to the embodiment of the support apparatus 100 (see description of FIG. 2 above). Specifically, the support apparatus 300 comprises more than one substantially longitudinal members 10 with each longitudinal member coupled transversally to an adjacent longitudinal member. Furthermore, a first portion 12 of an end of a side 16 of the support apparatus 300 may be coupled to a second portion 14 of an opposite end of an opposite side of the support apparatus (all details not specifically shown in FIG. 3, but the same as shown in FIGS. 1 and 2) in a manner as described above previously with respect to the support apparatus 100. According to FIG. 3 the support apparatus 300 further comprises one or more substantially flexible members (strips, bands or ribbons) 30, 32, 34 transversally located around each of the longitudinal members 10. In particular, with reference to FIG. 3, a top flexible member 30 illustrates that each of the remaining flexible members 32, 34 may surround an outer portion of the side 16. Furthermore, with regard to the top flexible member 30 and a bottom flexible member 34, the side 18 may also be surrounded. Thus, these top and bottom flexible members 30, 34 comprising, for example, a fabric or thermoplastic material and/or other materials and combinations thereof as is understood in the art may be folded to hide the open edge ragged appearance of the support apparatus 100 as shown in FIG. 1 and FIG. 2. Furthermore, these top and bottom flexible members 30, 34 may provide a more ornamental and finished appearance to the support apparatus 300. Of course, it is understood that all or only a portion of the top and/or bottom edge of the support apparatus could have the top and bottom flexible members 30, 34. The top flexible member 30 of the support apparatus 300 is depicted as having a first end 30*a* (shown partially in solid lines) and an opposite end 30*b* (shown in dashed lines) to illustrate that the first portion 12 of an end of the support apparatus may be coupled to the second portion 14 of an opposite end of the support apparatus as described above. The middle flexible member 32 shown in FIG. 3 is simply depicted as a band or ribbon surrounding an outer portion of the side 16. Of course, the flexible members 30, 32, 34 may be reduced or increased in number as desired and may be of any desired width, including but not limited to entirely covering the side 16 and/or the side 18 of the support apparatus 300. It will be further appreciated that instead of a band, the flexible members 30, 32, 34 could be threads of any width, which could be sewn to or otherwise threaded around each longitudinal member 10 as is readily understood in the art (see also FIG. 1 and FIG. 2). Further, the one or more flexible members 30, 32, 34 may comprise a thermoplastic such as polyethylene, polypropylene, polyamide, polyester and/or other co-polymers and formulations as are well understood in the art or that may be introduced into the marketplace at some future time. Thus, one or more thermoplastic flexible members 30, 32, 34 could be thermally coupled (or bonded) to one or more of the longitudinal members 10. Alternatively, one or more thermoplastic members 30, 32, 34 could be adhesively coupled to the one or more longitudinal members 10. Advantageously, it may be readily appreciated that the support apparatus 300 would be simple and economical to construct and has sufficient flexibility transversely to the longitudinal members 10 to provide any of the cross-sectional profiles described above with respect to FIGS. 1A-1C or any other profiles as would be desired. Consequently, the support apparatus 300 may be configured in conjunction with a variety of other objects to provide a variety of uses for the support apparatus (as described below with reference to FIG. 3A through to FIG. 3F).

Figure 3A:
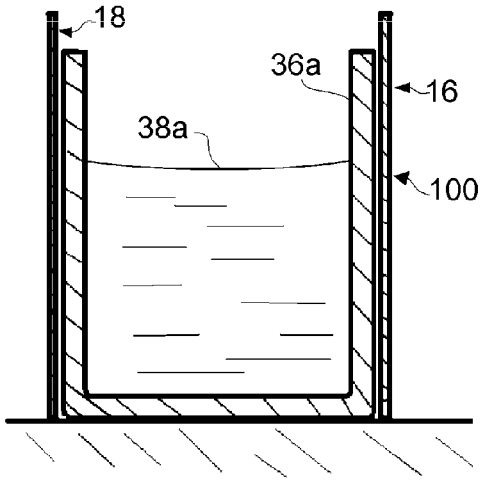
FIG. 3A depicts a cross-sectional side view of the support apparatus of FIG. 3 enclosing a container including a fluid or a solid.

FIG. 3A depicts a cross-sectional side view of the support apparatus 100 (200 or 300) enclosing a container 36*a* including a fluid or a solid 38*a*. In an aspect, the fluid 38*a* may be any beverage or the solid 38*a* may be any solid food that may have been stored in or added to the container 36*a*. For example, the container may be a can of beverage, food or soup taken on a picnic. The support apparatus 100 (200 or 300) may insulate the container 36*a* to maintain the can contents at a desired temperature (whether heated or cooled) while also providing a uniform ornamental appearance to one or more other containers that may be used.

Figure 3B:
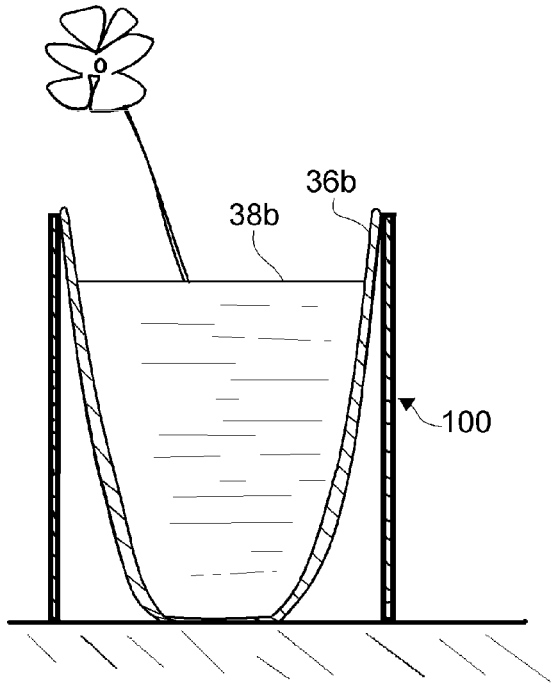
FIG. 3B depicts a cross-sectional side view of the support apparatus of FIG. 3 enclosing a vase.

FIG. 3B depicts a cross-sectional side view of the support apparatus 100 (200 or 300) enclosing a vase 36*b* including soil or water 38*b* with a flower planted or placed therein. Each vase 36*b* may have a variety of shapes and sizes. Consequently, it may be appreciated that the various configurations of the support apparatus 100 (200 or 300) may flexibly surround any type of vase to provide an ornamental appearance for each vase and further provide some insulation as desired when one or more plants located in the soil require special environmental conditions such as reduced sunlight.

Figure 3C:
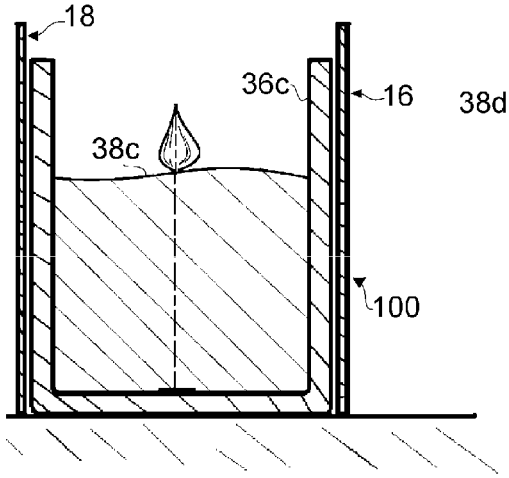
FIG. 3C depicts a cross-sectional side view of the support apparatus of FIG. 3 enclosing a candle or any light source in a container.

FIG. 3C depicts a cross-sectional side view of the support apparatus 100 (200 or 300) enclosing a candle 38*c* or any light source in a container 36*c*. According to FIG. 3C, the candle 38*c* has a wick embedded to an anchor located in a bottom portion of the container 36*c*, while the wick has been lit to provide a flame protected by a portion of the support apparatus 100 (200 or 300). In a readily understood example, the candle 38*c* in the container 36*c* may be a votive candle or any ornamental candle such as used in an intimate restaurant setting or home setting. Of course, the candle 38*c* may also comprise an electrical candle as is understood in the art.

Figure 3D:
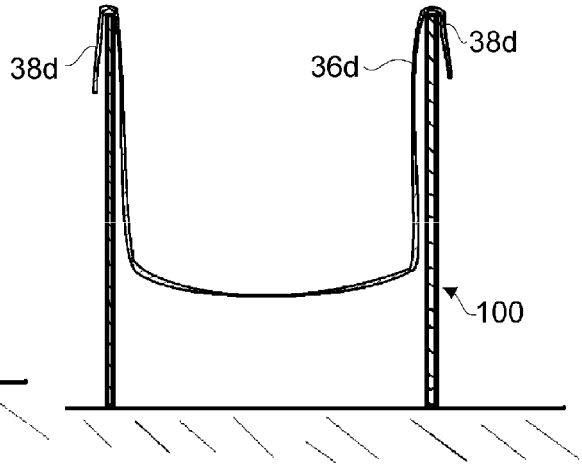
FIG. 3D depicts a cross-sectional side view of the support apparatus of FIG. 3 with a portion of a bag draping over a top edge of the support apparatus.

FIG. 3D depicts a cross-sectional side view of the support apparatus 100 (200 or 300) with a top portion 38*d* of a bag 36*d* (such as a re-sealable plastic lunch bag or any plastic grocery bag) draping (or supported by) over a top edge of the support apparatus (see also FIG. 5 and the description below for yet another embodiment of the support apparatus 400). It will be readily appreciated that the bag 36*d* may be of any size because the support apparatus 100 (200, 300 and/or 400) may be resized as needed (see description above), so that once again the support apparatus may be both economical and versatile in its use. Of course, an edge of the support apparatus 100 (200, 300 and/or 400) may comprise either of the top or bottom flexible members 30, 34 and the flexible members may comprise one or more materials that frictionally inhibit the bag from slipping off from the top (or bottom) flexible members.

In yet another aspect, the support apparatus 100 (200, 300 and/or 400) may comprise a hamper including the bag 36*d* that may be configured as a hamper bag to retain clothing therein, such as in a hotel/motel situation where a consumer may be traveling. Advantageously, a hotel/motel may provide the support apparatus 100 (200, 300 and/or 400) as an extra service and/or gift to a consumer, and the support apparatus may include any logos or advertising imprinted on a portion of the surface of the support apparatus according to the hotel/motel's desire.

In yet a further aspect, the support apparatus 100 (200, 300 and/or 400) including the bag 36*d* may comprise a convenient serving bowl for food or liquids that may have already been packed in the bag or that may be added to the bag while the bag was suspended along the edge of the support apparatus (as described above). It is further contemplated that one or more permanent or removable handles (not shown) may be coupled to a portion of the support apparatus 100 (200, 300 and/or 400) so that the support apparatus may be conveniently carried with a bag or other container coupled to a portion of the support apparatus in-situ.

Figure 3E:
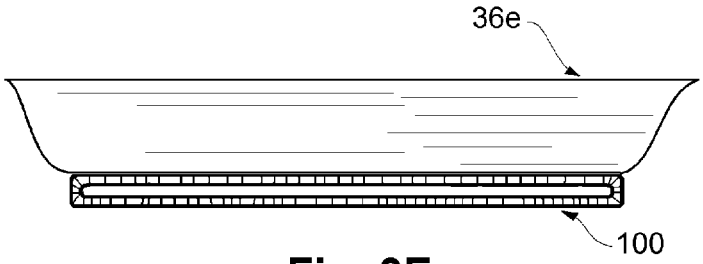
FIG. 3E depicts a side elevation view of the folded support apparatus of FIG. 3 configured as a trivet for a hot or a cold casserole dish.
Figure 3F:
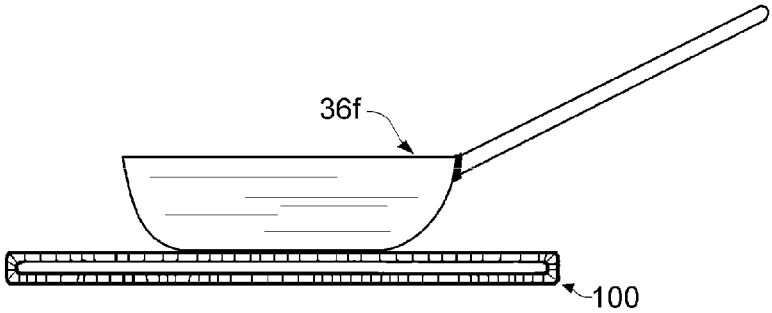
FIG. 3F depicts a side elevation view of the folded support apparatus of FIG. 3 configured as a trivet for a hot or a cold pot or pan located on a portion of the support apparatus.
Figure 7A:
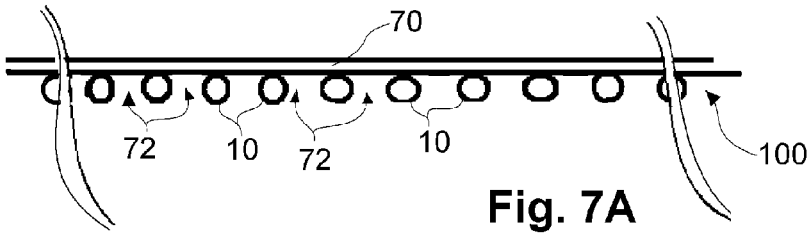
FIG. 7A depicts an exploded side elevation view of a portion of the support apparatus of FIG. 1.
Figure 7B:
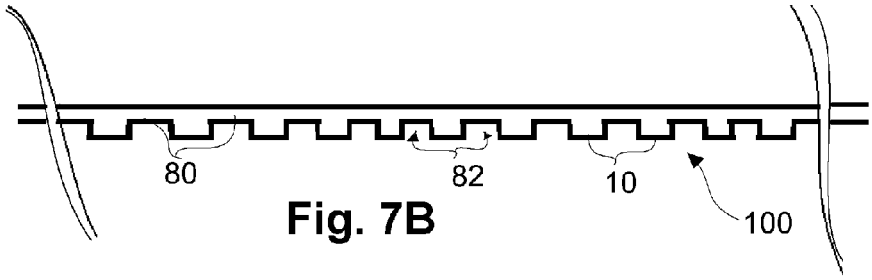
FIG. 7B depicts an exploded side elevation view of a portion of another embodiment of the support apparatus of FIG. 1.

FIG. 3E depicts a side elevation view of the folded support apparatus 100 (200 or 300) configured as a trivet for a hot or a cold casserole dish 36*e*. Similarly, FIG. 3F depicts a side elevation view of the folded support apparatus 100 (200 or 300) configured as a trivet for a hot or a cold pot or pan 36*f* located on a portion of the support apparatus. Both FIGS. 3E and 3F illustrate that the support apparatus 100 (200 or 300) may be readily collapsed and used in a variety of ways. Of course, the insulating properties of the support apparatus 100 (200 or 300 and/or other embodiments 400 such as shown in FIGS. 4, 4A, 4B and 4C) depends on the materials of construction of the longitudinal members 10 and any transverse coupling members 70 or 80 such as shown in FIGS. 7A and 7B (see also the description below). Naturally, when used as an unfolded support apparatus 100 (200 or 300) as illustrated in FIG. 1 and described above, the support apparatus may also be used as a conventional placemat.

Figure 4:
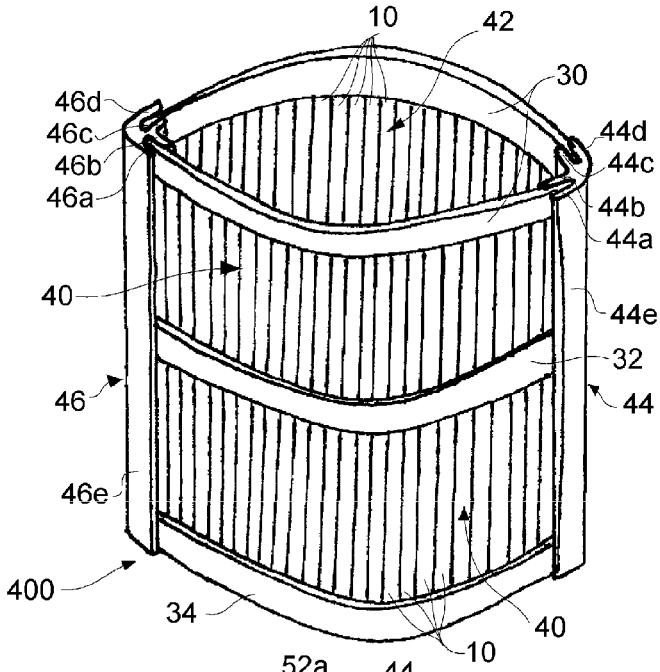
FIG. 4 depicts a front perspective view of yet another embodiment of a support apparatus according to another exemplary embodiment of the invention.

Turning now to FIG. 4, in a front perspective view of yet another embodiment of a support apparatus 400, the support apparatus may comprise a first assembly 40 including a plurality of longitudinal members 10 and a second assembly 42 including a plurality of longitudinal members 10. The plurality of longitudinal members 10 may be identical with those as described above with respect to the support apparatus 100, 200 and 300 and shown in FIGS. 1 to 3 inclusively. Each of the first assembly 40 and the second assembly 42 may be flexibly biased in a substantially transverse direction relative to the substantially rigid longitudinal members 10. In an aspect of the support apparatus 400, the substantially rigid longitudinal members 10 may comprise a strip of material such as bamboo, wood or other natural fibrous material with a greater rigidity in a longitudinal direction than in a transverse direction or any other synthetic material such as substantially rigid thermoplastic or thermoset plastics that are well understood in the art or may be introduced in the future, or mixtures of natural and synthetic materials and the like (see also the description above with regard to the support apparatus 100). The longitudinal members 10 of the first assembly 40 and of the second assembly 42 may be coupled to one another with one or more flexible members (or strips, bands, threads and the like) 30, 32, 34 as described above with regard to FIG. 3. Of course, the longitudinal members 10 could also be sewn together or be molded out of one or more sheets of a substantially flexible thermoplastic material or comprise a composite of a substantially flexible fiber reinforced mesh (such as a knit) or of any other substantially fiber reinforced material as is well understood in the art. The support apparatus 400 may further comprise a first hinge member 44 and a second hinge member 46, wherein an end of the first assembly 40 and an end of the second assembly 42 may be coupled to a portion of the first hinge member 44. Similarly, an opposite end of the first assembly 40 and an opposite end of the second assembly 42 may be coupled to a portion of the second hinge member 46. Naturally, in an alternative embodiment, the first and second assemblies 40 and 42 may comprise a single assembly including the plurality of longitudinal members 10, wherein a portion of the single assembly may be folded upon itself to enclose the first and the second hinge members 44, 46.

Referring now to details of the first and second hinge members 44 and 46, according to FIG. 4, each hinge member (44 or 46), may comprise a first longitudinal wall 44*a* (or correspondingly 46*a*), a second longitudinal wall 44*b* (or correspondingly 46*b*), a third longitudinal wall 44*c* (or correspondingly 46*c*) and a fourth longitudinal wall 44*d* (or correspondingly 46*d*) wherein each of the four longitudinal walls comprise a portion of a main wall 44*e* (or correspondingly 46*e*). The walls 44*a* and 44*b* may define a channel configured to receive the end of the first assembly 40, while the walls 46*a* and 44*b* may define an opposite channel configured to receive the opposite end of the first assembly 40. Similarly, the walls 44*c* and 44*d* may define a channel configured to receive the end of the second assembly 42, while the walls 46*c* and 44*d* may define an opposite channel configured to receive the opposite end of the first assembly 42. Of course, the ends and opposite ends of the first and second assemblies 40, 42 may be coupled in any manner as might be expected such as simply with a close fit or by means of any type of adhesive as would be understood in the art. It will be further understood that the first and second assemblies 40, may be molded as an integral structure with the hinge members 44 and 46.

Figure 4A:
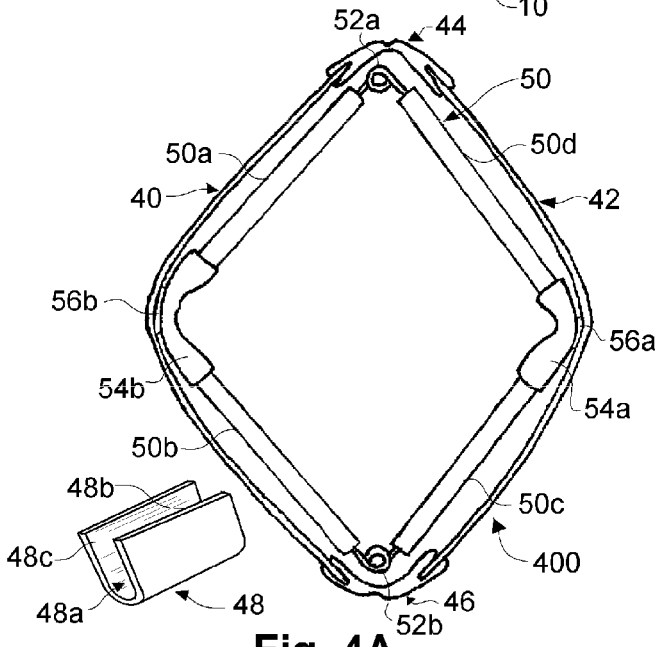
FIG. 4A depicts a bottom plan view of the support apparatus of FIG. 4 in an open configuration with a front perspective view of a retainer.

FIG. 4A depicts a bottom plan view of the support apparatus 400 in an open configuration with a front perspective view of a retainer 48. In an aspect of the disclosure, one or more rod shaped spreader arms 50*a*, 50*b*, 50*c*, 50*d* may comprise a torsion assembly 50 that holds the first and second assemblies 40, 42 in an open position. Of course, the spreader arms 50*a*, 50*b*, 50*c*, 50*d* may have any suitable shape. The torsion assembly 50 may further comprise an end of a first torsion spring 52*a* coupled to an end of the spreader arm 50*a* and an opposite end of the spreader arm 50*d* coupled to an opposite end of the first torsion spring 52*a*. Similarly, the torsion assembly 50 may further comprise an end of a second torsion spring 52*b* coupled to an end of the spreader arm 50*c* and an opposite end of the spreader arm 50*b* coupled to an opposite end of the second torsion spring 52*b* to permit opening of the spreader arms 50*a*, 50*b*, 50*c* and 50*d* to about a right angle. In addition, the torsion assembly 50 may further comprise a first connector 54*a* with an end of the first connector coupled to an end of the spreader arm 50*d* and an opposite end of the first connector coupled to an opposite end of the spreader arm 50*c*. Further, the torsion assembly 50 may comprise a second connector 54*b* with an end of the second connector coupled to an end of the spreader arm 50*b* and an opposite end of the second connector coupled to an opposite end of the spreader arm 50*a*. Both of the connectors 54*a*, 54*b* may each comprise one or more flexible tubular members and may comprise any rubbers or plastics as is understood in the art. In an aspect of the disclosure, a portion of an outer surface of the first connector 54*a* may be coupled to a portion of an inner surface of the first assembly 42, while a portion of an outer surface of the second connector 54*b* may be coupled to a portion of an inner surface of the second assembly 40. Such coupling may be conveniently accomplished with any type of adhesive or by thermoplastic welding as desired or by mechanical fastening if otherwise desired as is well understood in the art.

Figure 4B:
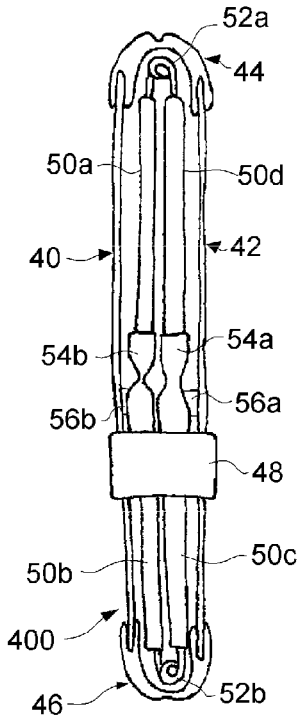
FIG. 4B depicts a side elevation view of the support apparatus of FIG. 4 in a folded configuration with the retainer of FIG. 4A coupled to a portion of the support apparatus.
Figure 4C:
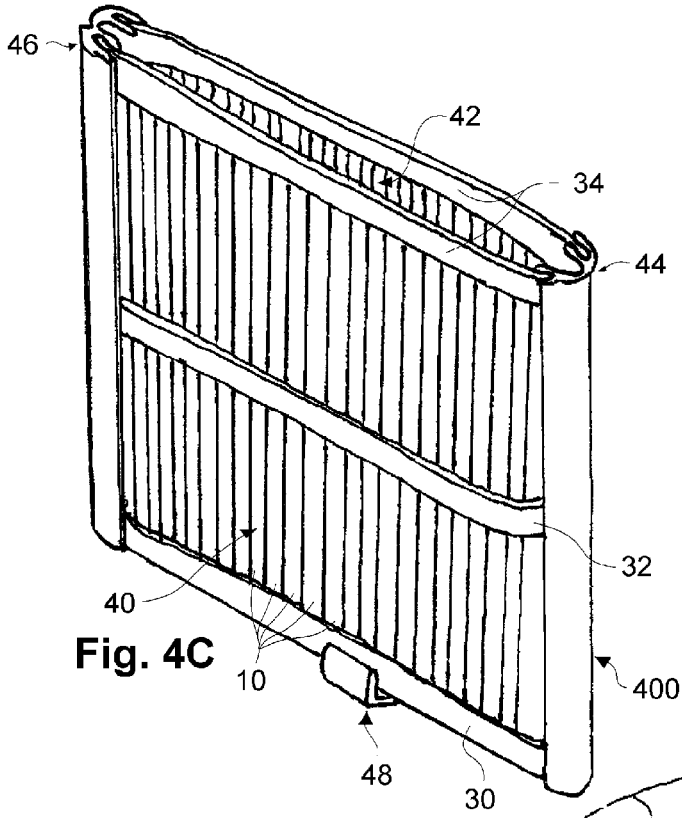
FIG. 4C depicts a side perspective view of the support apparatus of FIG. 4 in a folded configuration with the retainer of FIG. 4A coupled to a portion of the support apparatus.

FIG. 4A also depicts a side perspective view of the retainer 48. The retainer 48 may be substantially U-shaped in cross-section. As would be expected, since the hinge members 44 and 46 may be substantially flexible, each of the first and second assemblies 40, 42 may be pushed to a flattened state as shown with reference to FIG. 4B. FIG. 4B depicts a side elevation view of the support apparatus 400 in a folded configuration with the retainer 48 coupled to a portion of the support apparatus, while FIG. 4C depicts a side perspective view of the support apparatus in a folded configuration with the retainer coupled to a portion of the support apparatus. The retainer 48 having a U-shaped channel 48*a* may be defined by two contiguous inner walls 48*b*, 48*c* of the retainer and may maintain the first and second assemblies 40, 42 in a flattened (closed) state by placing the support apparatus 400 into the U-shaped channel of the retainer as illustrated in both FIGS. 4B and 4C. Thus, an outer portion of the first assembly 40 may contact the inner wall 48*b* of the retainer 48, while an outer portion of the second assembly 42 may contact the inner wall 48*c* of the retainer.

Figure 5:
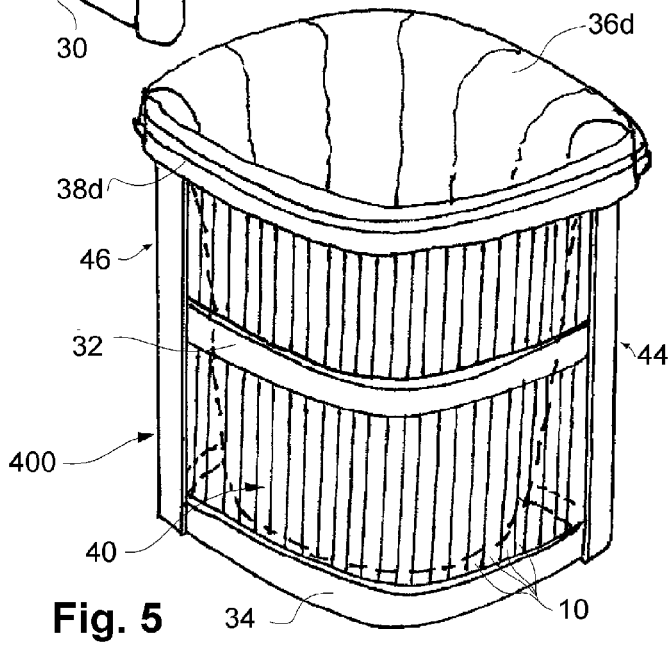
FIG. 5 depicts a front perspective view of the embodiment of the support apparatus of FIG. 4 configured with a resealable bag.

FIG. 5 depicts a front perspective view of the support apparatus of 400 configured with a re-sealable bag 36*d*. a lower portion of the bag 36*d* has been depicted with dotted lines to illustrate that the bag is located in an inner portion of the support apparatus. Furthermore, a lip (or top) portion 38*d* of the bag 36*d* may be folded over a top portion of the support apparatus 400 between the first and second assemblies 40, 42 thereby holding the bag in an upright and open position. Without limiting the disclosure, the support apparatus 400 may be sized to hold any bag including but not limited to a re-sealable plastic bag such as a one gallon bag or a one quart bag. In an aspect of the disclosure, the height of the support apparatus 400 may be sized so that the bottom of the bag 36*d* may contact a portion of a surface upon which the support apparatus may rest. In this way, the support apparatus 400 located on the portion of the surface may limit tension on the bag when it is desired to fill the bag 36*d* with one or more products such as food, including soup and/or other liquid ingredients. Naturally, in ordinary use, since a lip (or top) portion of the bag 36*d* may be folded over an edge (top rim portion) 22 of the support apparatus 400, the edge may be configured to provide enhanced frictional contact between the outer surface of the bag with any desired altered outer surface of the top flexible member 30. Thus, slippage of the bag 36*d* due to any gravitational effect of adding contents into the bag 36*d* may be overcome. Advantageously, since the support apparatus 400 may hold the bag 36*d* in an open and upright position without any other means (such as cumbersome use of hands by a consumer), contents may be freely poured into the bag thereby avoiding potential spilling. Naturally, the support apparatus 400 may also be used to temporarily store unwanted items such as fruit or vegetable peelings, which may be discarded by removing the bag from the support apparatus. As expected, the support apparatus 400 may also retain other types of disposable bags for holding trash items such as plastic bags commonly used in the purchase of fruits and vegetables at the grocery store. Because such disposable bags may be completely surrounded by the support apparatus 400 (or of course 100, 200 or 300 as described above), the support apparatus may be placed as an ornamental object on a kitchen counter without seeming unsightly. In yet another aspect illustrating the usefulness and adaptability of the support apparatus 400 a consumer may mix food ingredients in a disposable bag 36*d* rather then in a mixing bowl, which might otherwise then have to be cleaned and dried. Additionally, the mixed ingredients can be stored in the re-sealable bag and the filled bag could then be removed from the support apparatus 400 or alternatively the filled bag and the support apparatus may be stored in a refrigerator for later use. Without limiting the disclosure, the above descriptions of use of the support apparatus 400 may also apply to other embodiments of the support apparatus such as 100, 200 and 300 (see above).

Figure 6:
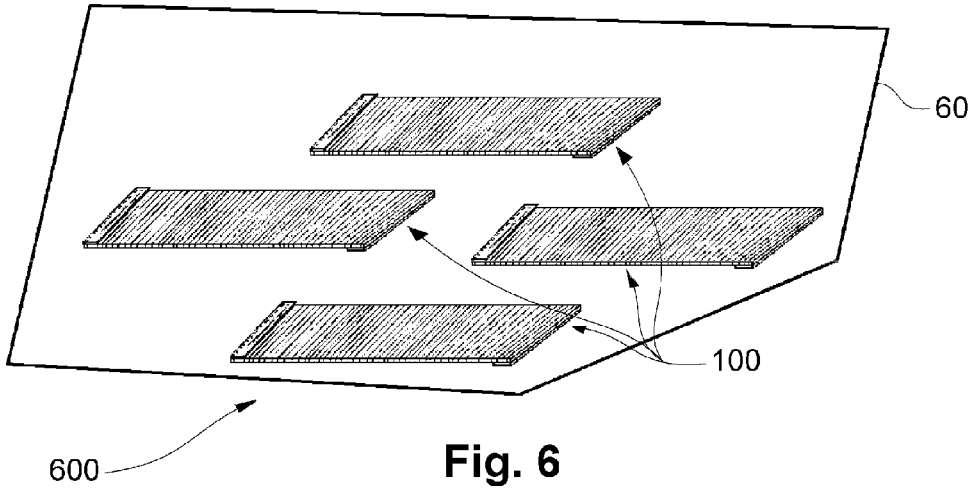
FIG. 6 depicts a front perspective view of a kit comprising a plurality of the support apparatus of FIG. 1 located in a package.

FIG. 6 depicts a front perspective view of a kit 600 comprising a plurality of the support apparatus 100 in an open configuration located in a package 60. Since the package 60 may be sized as desired, of course any configuration of the support apparatus 100 (200, 300 or 400) may be located in the package. Advantageously, different sized support apparatus 100 (200, 300 or 400) may be to provide a consumer with multiple choices with respect to objects used in conjunction with the support apparatus as described above. Naturally, the package 60 may comprise any one or any combination of opaque, substantially transparent or translucent materials as is understood in the art.

FIG. 7A depicts an exploded side elevation view of a portion of the support apparatus 100 (200, 300 or 400) to better illustrate details of construction of one or more flexible transverse support members 70 (configured as a flexible sheet material) coupled to the longitudinal members 10. As illustrated in FIG. 7A, when the longitudinal members 10 comprise individual strips (shown rounded although it is to be understood the cross-sectional profile of the longitudinal members may comprise any desired shape), an outer portion of a surface of the flexible sheet 70 may be adhesively coupled to a portion of an outer surface of each longitudinal member. Thus, a portion of an outer surface of a first longitudinal member 10, a portion of an outer surface of an adjacent second longitudinal member and a portion of an outer surface of the flexible sheet 70 adjacent to the outer surface of each of the first and second longitudinal members may define an opening 72. Consequently, each of the longitudinal members 10 may readily rotate about a longitudinal axis of each of the first and second adjacent longitudinal members (see earlier description above).

Similarly, FIG. 7B depicts an exploded side elevation view of a portion of another embodiment of the support apparatus 100 (200, 300 or 400) wherein one or more flexible transverse support members 80 may be coupled to each of an adjacent pair of substantially longitudinal members 10 (shown with a rectangular or square cross-sectional profile). As described above with regard to FIG. 7A, a portion of an outer surface of a first longitudinal member 10, a portion of an outer surface of an adjacent second longitudinal member and a portion of an outer surface of a transverse support member 80 adjacent to the outer surface of each of the first and second longitudinal members may define an opening 82. Consequently, each of the longitudinal members 10 may readily rotate about a longitudinal axis of each of the first and second adjacent longitudinal members (see earlier description above).

While the invention has been particularly shown and described with reference to preferred embodiments thereof, it will be understood by those skilled in the art that the foregoing and other changes in form and details may be made therein without departing from the spirit and scope of the invention. The scope of the present invention is not intended to be limited by the specific examples set out herein.

What is claimed is:

1. A versatile support apparatus, comprising in combination:

an assembly including a plurality of substantially rigid natural fibrous longitudinal members;

at least one substantially flexible member coupled transversally to a portion of each of said plurality of longitudinal members and adapted to bind each of said plurality of longitudinal members to an adjacent one of said plurality of longitudinal members, wherein each longitudinal member of said plurality of longitudinal members is repositionable about a longitudinal axis of said longitudinal member allowing said apparatus to be rolled;

a portion of a first end of a first longitudinal side of said assembly selectively couple-able to a portion of an opposite second end of an opposite second longitudinal side of said assembly, wherein when said portion of said first end is coupled to said portion of said opposite second end, said support apparatus is configured to support an object within an inner portion of said assembly; and a second versatile support apparatus comprising a second assembly including a second plurality of substantially rigid natural fibrous longitudinal members, at least one substantially flexible member coupled transversally to a portion of each of said second plurality of longitudinal members, each longitudinal member of said second plurality of longitudinal members repositionable about a longitudinal axis of said longitudinal member; and a portion of a third end of a third longitudinal side of said second assembly selectively couple-able to a portion of an opposite fourth end of an opposite fourth longitudinal side of said second assembly; wherein:

said portion of said first end is couple-able to said portion of said fourth end; and said portion of said third end is couple-able to said portion of said second end, whereby a end-to-end extended support apparatus is formed.

* * * * *